United States Patent [19]

Sung et al.

[11] 4,392,866

[45] Jul. 12, 1983

[54] ETHERAMINE CORROSION INHIBITOR FOR ALCOHOLS

[75] Inventors: Rodney L. Sung, Fishkill; George J. Sidote, Hopewell Junction; William M. Sweeney, Wappingers Falls, all of N.Y.

[73] Assignee: Texaco Inc., White Plains, N.Y.

[21] Appl. No.: 318,532

[22] Filed: Nov. 5, 1981

[51] Int. Cl.[3] ..... C10L 1/22

[52] U.S. Cl. ..... 44/53; 106/14.13; 106/14.15; 252/392; 252/396; 422/12; 564/505; 564/508

[58] Field of Search ..... 44/53; 252/392, 396; 106/14.13, 14.15; 422/12; 564/505, 508; 568/701

[56] References Cited

U.S. PATENT DOCUMENTS

| | | | |
|---|---|---|---|
| 3,206,512 | 9/1965 | Koebner et al. | 564/505 |
| 4,139,478 | 2/1979 | Hochreuter | 564/505 |
| 4,261,704 | 4/1981 | Langdon | 564/505 |
| 4,321,060 | 3/1982 | Sung et al. | 252/392 |
| 4,348,210 | 9/1982 | Sung | 252/392 |

*Primary Examiner*—Irwin Gluck

*Attorney, Agent, or Firm*—Carl G. Ries; Robert A. Kulason; Carl G. Seutter

[57] ABSTRACT

Alcohols may be inhibited against corrosion by addition thereto of an ether amine $$(ROR')_a-\underset{\underset{H_{3-a-b}}{|}}{N}-(R''NH_2)_b$$

typically $C_{12}H_{25}OCH_2CH_2CH_2NHCH_2CH_2CH_2NH_2$.

22 Claims, No Drawings

ETHERAMINE CORROSION INHIBITOR FOR ALCOHOLS

FIELD OF THE INVENTION

This invention relates to alcohol products particularly characterized by decreased ability to corrode metal surfaces with which they come into contact.

BACKGROUND OF THE INVENTION

As is well known to those skilled in the art, alcohols such as ethanol may corrode metal surfaces with which they come into contact. This is particularly true of crude or commercially available ethanols which undesirably contain acidic components commonly acetic acid. In the case of fermentation alcohols, acetic acid may be present in amount of 0.003 w %–0.005 w % of the alcohol; and this may be responsible for the fact that the alcohol causes serious corrosion problems.

It is an object of this invention to provide a novel process for decreasing the corrosion of alcohol compositions. Other objects will be apparent to those skilled in the art.

STATEMENT OF THE INVENTION

In accordance with certain of its aspects, the novel composition of this invention may comprise (i) a water-soluble alcohol preferably selected from the group consisting of ethanol and methanol; and (ii) an effective anti-corrosion inhibiting amount of as corrosion-inhibiting agent an amine having the formula $$(ROR')_a-\underset{\underset{H_{3-a-b}}{|}}{N}-(R''NH_2)_b$$

wherein R contains 1–30 carbon atoms and is selected from the group consisting of alkyl, alkenyl, alkaryl, aralkyl, cycloalkyl, and aryl groups, and R′ and R″ are divalent hydrocarbon group containing 1–30 carbon atoms and are selected from the group consisting of alkylene, alkenylene, alkarylene, aralkylene, cycloalkylene, and arylene groups, and a and b are each an integer less than 3, and a plus b is less than 4. R and R″ may be the same or different.

DESCRIPTION OF THE INVENTION

The alcohol compositions which may be treated by the process of this invention may include $C_1$–$C_{12}$ alkanols such as water-soluble alkanols including $C_1$–$C_4$ alcohols. Preferably, the alcohols include methanol, ethanol, propanols, etc. The alcohols may include mixtures of alcohols with each other and/or with other compositions including ketones, esters, hydrocarbons, etc. The alcohol may be in the form of gasohol—a mixture commonly containing 80 v %–95 v % say 90 v % gasoline and 5 v %–20 v %, say 10 v % alcohol. The alcohol may contain water, for example up to 10 w %–20 w %, typically 5 w %; but preferably it will be anhydrous. If intended to be used in gasohol, the alcohol will preferably be anhydrous. Anhydrous compositions commonly contain less than about 0.3 v % water, typically 0.001 v %–0.005 v %, say about 0.004 v % water. One preferred charge may be 100% anhydrous ethanol. Another preferred charge may be 100% anhydrous methanol.

Commercially available mixtures may be employed. Illustrative of one such commercially available mixture may be that having the following typical analysis:

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2. |

It is a particular feature of the process of this invention that it may be used to treat such compositions when they are to be used as fuels.

The fuels which may be treated by the process of this invention include gasohols which may be formd by mixing 90–95 volumes of gasoline with 5–10 volumes of ethanol or methanol. A typical gasohol may contain 90 volumes of gasoline and 10 volumes of absolute ethanol.

The fuels to be treated by the process of this invention may be substantially anhydrous i.e. they contain less than about 0.3 v % water; typically they may contain 0.001 v %–0.005 v %, say about 0.004 v % water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w %–0.005 w % of the total of the alcohol.

In accordance with practice of the process of this invention, there may be added to the alcohol a minor effective corrosion-inhibiting amount of, as a corrosion inhibiting additive, an amine having the formula $$(ROR')_a-\underset{\underset{H_{3-a-b}}{|}}{N}-(R''NH_2)_b$$

wherein R contains 1–30 carbon atoms and is selected from the group consisting of alkyl, alkenyl, alkaryl, aralkyl, cycloalkyl, and aryl groups and R′ and R″ are divalent hydrocarbon group containing 1–30 carbon atoms and are selected from the group consisting of alkylene, alkenylene, alkarylene, aralkylene, cycloalkylene, and arylene groups, and a and b are each an integer less than 3, i.e. 1–2 and a+b is less than four. R and R″ may the same or different.

In the above compound, R may be hydrocarbon radical selected from the group consisting of alkyl, aralkyl, cycloalkyl, aryl, alkaryl, and alkenyl, including such radicals when inertly substituted. When R is alkyl, it may typically be methyl, ethyl, n-propyl, iso-propyl, n-butyl, i-butyl, sec-butyl, amyl, octyl, decyl, octadecyl, etc. When R is aralkyl, it may typically be benzyl, beta-phenylethyl, etc. When R is cycloalkyl, it may typically by cyclohexyl, cycloheptyl, cyclooctyl, 2-methylcycloheptyl, 3-butylcyclohexyl, 3-methylcyclohexyl, etc. When R is aryl, it may typically be phenyl, naphthyl, etc. When R is alkaryl, it may typically be tolyl, xylyl, etc. When R is alkenyl, it may typically be vinyl, allyl, 1-butenyl, etc. R may be inertly substituted i.e. it may bear a non-reactive substituent such as alkyl, aryl, cycloalkyl, ether, etc. Typically inertly substituted R groups may include 2-ethoxyethyl, carboethoxymethyl, 4-methyl cyclohexyl, etc. The preferred R groups may be alkyl group having 6–20 carbon atoms including eg hexyls, octyls, decyls, etc. R may more preferably be a $C_6$–$C_{13}$, still more preferably a $C_{13}$ straight chain alkyltridecyl.

R′ and R″ are divalent hydrocarbon groups which may be selected from the same group as that from which R is selected but having one less hydrogen atom. Preferably R′ and R″ are $C_2$–$C_3$ groups i.e. $—CH_2—CH_2—$ or $—CH_2—CH_2—CH_2$.

In the formula a is an integer 1–2.

It will be apparent that when a is 1 and b is 1, the formula may be $$(ROR')—NH—(R''NH_2)$$

and the composition may be typified by:

TABLE $C_6H_{13}O(CH_2)_3—NH—(CH_2)_2NH_2$ $C_9H_{19}O(CH_2)_2—NH—(CH_2)_3NH_2$ $C_{12}H_{25}O(CH_2)_3—NH—(CH_2)_3NH_2$

It wll be apparent that when a is 1 and b is 2, the formula will be $(ROR')—N—(R''NH_2)_2$ and the compositions may be typified by:

TABLE $C_6H_{13}O(CH_2)_3N[(CH_2)_2NH_2]_2$ $C_9H_{19}O(CH_2)_3N[(CH_2)_2NH_2]_2$ $C_{12}H_{25}O(CH_2)_3N[(CH_2)_3NH_2]_2$

It will be apparent that when a is 2 and b is 1, the formula will be $(ROR')_2N(R''NH_2)$ and the compositions may be typified by:

$(C_6H_{13}OCH_2CH_2CH_2CH_2)_2N(CH_2CH_2CH_2NH_2)$ $(C_9H_{19}OCH_2CH_2CH_2)_2N(CH_2CH_2NH_2)$ $(C_{12}H_{25}OCH_2CH_2CH_2)_2N(CH_2CH_2NH_2)$

The preferred composition may be tridecyloxypropylaminopropylamine $C_{13}H_{27}OCH_2CH_2CH_2NHCH_2CH_2CH_2NH_2$.

These compositions may be available commercially or they may be synthesized by reaction of typically $$C_{13}H_{27}OH + CH_2{=}CH{-}CN \longrightarrow C_{13}H_{27}O{-}CH_2CH_2CN$$

$$C_{13}H_{27}O{-}CH_2CH_2CN \xrightarrow{\text{Pt-on-C}} C_{13}H_{27}O{-}CH_2CH_2CH_2NH_2$$

$$C_{13}H_{27}O{-}(CH_2)_3NH_2 + CH_2{=}CH{-}CN \xrightarrow{\text{Pt-on-C}} C_{13}H_{27}O{-}(CH_2)_3NH{-}(CH_2)_3{-}NH_2$$

Illustrative commercially available compositions may be the following, the first listed being a preferred composition:

TABLE

A. The Tomah DA-17 (of the Tomah Company) brand of tridecyl (oxypropyl) aminopropylamine:

$$C_{13}H_{27}—O—(CH_2)_3—NH(CH_2)_3NH_2.$$

B. The Tomah DA-14 brand of decyloxypropylaminopropylamine.

The so prepared rust and corrosion inhibitors may be added to an alkanol in minor corrosion-inhibiting amount of 0.25–25, preferably 1–20 PTB, more preferably 1–5 PTB, say 2 PTB. (PTB stands for pounds of additive per thousand barrels of alcohol or fuel). Alternatively expressed, the inhibitor may be added in amount of 0.0001–0.01 w %, preferably 0.0004–0.008 w %, more preferably 0.0004–0.002 w %, say 0.0008 w %. Larger amounts may be employed, but may not be necessary.

It is a feature of this invention that the alcohol composition so prepared is characterized by its increased corrosion and rust inhibition i.e. its decreased ability to form rust on iron surfaces in the presence of aqueous acid systems.

The corrosive nature of the formulated products may be readily measured by the Iron Strip Corrosion Test (ISCT). In this test, an iron strip (12 mm×125 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 100 ml of the test liquid in a 4 ounce bottle for 15 minutes at room temperature of 20° C. 10 ml of the test liquid is poured off and replaced with 10 ml of distilled water. The bottle is shaken the sample is maintained at 90° F. The percent rust on the strip is determined visually. Readings may be taken at noted intervals depending on the system typically after say three hours, three days, and six days.

The inhibited alcohols of this invention, after 40 hours of ISCT generally show a Rust and Corrosion rating below about 2–3% and frequently as low as trace-to-1%.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this Example of the best mode of practicing the invention, 384 ppm of Tomah DA-17 brand of tridecyl (oxypropyl) aminopropylamine (100 PTB) are added as additive to 90 parts of absolute alcohol drawn from a reservoir having the composition of Table I supra.

Distilled water (10 parts) is added and the system is subjected to the ISCT. The iron strip is observed after 3 days.

EXAMPLE II*

In this control example, the test procedure of Example I is duplicated except that the additive is 100 PTB of the Arquad 2C/75 brand of $[R_2N(CH_3)]^+Cl^-$, wherein R is COCO in place of the additive of Example I.

EXAMPLE III*

In this control Example, no additive is present.

The results of the Iron Strip Corrosion Test were as follows:

TABLE

| Example | Three-Day Rust & Corrosion Rating |
|---|---|
| I | 0-trace |
| II* | 100% after 2 hours |
| III* | 20%-25% |

From the above table, it will be apparent that the system of Example I, prepared in accordance with practice of this invention showed only a trace of rust and corrosion after 3 days. Control Example II showed 100% rust and corrosion after two hours which is unsatisfactory. The blank (control example III) showed 20%-25% after three days. This is unsatisfactory.

EXAMPLES IV-VII

In this series of examples, the procedure of Examples I-III is duplicated except that the iron strip is replaced by a zinc strip which is prepared in manner similar to that used for the iron strip.

The alcohol used in Examples IV-VII is 100% absolute methanol.

The additives in the several examples are as follows:

| Example | Parts (PTB) | Additive |
|---|---|---|
| IV | 200 | Reaction product of maleic anhydride and Armeen D A-13 brand of tridecyoxypropylamine |
| V | 100 | Ethoduomeen C/12 brand of N,N',N'—polyoxyethylene (10) N—tallow 1,3-diaminopropane |
| VI | 100 | tridecyloxypropyl aminopropylamine |
| VII* | None | None (control) |

The results of the zinc strip corrosion test were as follows:

TABLE

| Example | % Corrosion After 5 Days |
|---|---|
| IV* | 10% |
| V* | 20% |
| VI | 0-trace |
| VII* | 75% |

From the above table, it will be apparent that only Example VI prepared in accordance with this invention is satisfactory—shown only a trace of corrosion after five days. Control Examples IV*, V*, and VII* were unsatisfactory.

Results comparable to these attaind in Example VI may be attained when the additive is:

TABLE

| Example | Additive |
|---|---|
| VIII | Nonyloxypropylaminopropylamine |
| IX | dodecyloxypropylaminopropylamine |
| X | tetradecyloxypropylaminopropylamine |
| XI | pentadecyloxypropylaminopropylamine |

TABLE

| Example | Alcohol |
|---|---|
| XII | Gasohol containing 90 v % gasoline and 10 v % absolute ethanol. (It will be noted that this formulation separates into two phases on addition of water in the ICST.) |
| XII | Absolute ethanol |

The additives of this invention permit attainment of desirable corrosion inhibition in alcohol systems in marked contrast to those falling outside the scope of the invention. Illustrative of such materials which do not function satisfactorily are the following:

TABLE

| Example | Additive |
|---|---|
| XIV* | dimethyldisoya ammonium chloride |
| XV* | trimethylsoya ammonium chloride |
| XVI* | trimethyltallow ammonium chloride |

Although this invention has been illustrated by reference to specific embodiments, it will be apparent to those skilled in the art that various changes and modifications may be made which clearly fall within the scope of this invention.

What is claimed is:

1. A composition comprising (i) a water-soluble alcohol; and (ii) as corrosion inhibiting additive an effective corrosion-inhibiting amount of an amine having the formula $$(ROR')_a-\underset{\underset{H_{3-a-b}}{|}}{N}-(R''NH_2)_b$$

wherein R contains 1-30 carbon atoms and is selected from the group consisting of alkyl, alkenyl, alkaryl, aralkyl, cycloalkyl, and aryl groups and R' and R'' are the same or different divalent hydrocarbon group containing 1-30 carbon atoms and are selected from the group consisting of alkylene, alkenylene, alkarylene, aralkylene, cycloalkylene, and arylene groups, and a and b are each an integer 1-2, and a plus b is less than four.

2. A composition as claimed in claim 1 wherein said water-soluble alcohol composition contains ethanol.

3. A composition as claimed in claim 1 wherein said water-soluble alcohol composition contains methanol.

4. A composition as claimed in claim 1 wherein said water-soluble alcohol composition contains anhydrous methanol or ethanol.

5. A composition as claimed in claim 1 wherein said water-soluble alcohol composition contains ethanol together with acidic contaminants.

6. A composition as claimed in claim 1 wherein said additive is $(ROR')NH(R''NH_2)$.

7. A composition as claimed in claim 6 wherein R is a $C_6$–$C_{13}$ alkyl.

8. A composition as claimed in claim 6 wherein R' is a $C_2$–$C_3$ straight chain alkyl.

9. A composition as claimed in claim 6 wherein R is a $C_6$–$C_{13}$ straight chain alkyl and R' and R'' are $C_2$–$C_3$ straight chain alkyl.

10. A composition as claimed in claim 6 wherein said additive is $C_{12}H_{25}OCH_2CH_2CH_2—NHCH_2CH_2CH_2NH_2$.

11. A composition as claimed in claim 1 wherein said additive is $(ROR')_2N(R''NH_2)$.

12. A composition as claimed in claim 11 wherein R is a $C_6$–$C_{13}$ alkyl.

13. A composition as claimed in claim 11 wherein R' and R'' are $C_2$–$C_3$ straight chain alkyl.

14. A composition as claimed in claim 11 wherein R is a $C_6$–$C_{13}$ straight chain alkyl and R' and R'' are $C_2$–$C_3$ straight chain alkyl.

15. A composition as claimed in claim 11 wherein said additive is $(C_{12}H_{25}OCH_2CH_2CH_2)_2N(CH_2CH_2NH_2)$.

16. A composition as claimed in claim 1 wherein said additive is $(ROR')\ N\ (R''NH_2)_2$.

17. A composition as claimed in claim 16 wherein R is a $C_6$–$C_{13}$ alkyl.

18. A composition as claimed in claim 16 wherein R' and R'' are $C_2$–$C_3$ straight chain alkyl.

19. A composition as claimed in claim 16 wherein R is a $C_6$–$C_{13}$ straight chain alkyl and R' and R'' are $C_2$–$C_3$ straight chain alkyl.

20. A composition as claimed in claim 16 wherein said additive is $(C_{12}H_{25}OCH_2CH_2CH_2)N(CH_2CH_2CH_2NH_2)_2$.

21. A composition comprising:

(i) at least one of ethanol and methanol and (ii) 0.25–25 PTB of $C_{12}H_{25}OCH_2CH_2CH_2NHCH_2CH_2CH_2NH_2$.

22. The method of inhibiting against corrosion a water-soluble alcohol composition which comprises adding to said water-soluble alcohol composition an amine having the formula $$(ROR')_a—\underset{\underset{H_{3-a-b}}{|}}{N}—(R''NH_2)_b$$

wherein R contains 1–30 carbon atoms and is selected from the group consisting of alkyl, alkenyl, alkaryl, aralkyl, cycloalkyl, and aryl groups and R' and R'' are divalent hydrocarbon group containing 1–30 carbon atoms and is seleced from the group consisting of alkylene, alkenylene, alkarylene, aralkylene, cycloalkylene, and arylene groups, and a and b are each an integer 1–2, and a plus b is less than four.

* * * * *